US010767641B2

(12) United States Patent
Corigliano et al.

(10) Patent No.: US 10,767,641 B2
(45) Date of Patent: Sep. 8, 2020

(54) MICROPUMP WITH ELECTROSTATIC ACTUATION

(71) Applicant: POLITECNICO DI MILANO, Milan (IT)

(72) Inventors: Alberto Corigliano, Milan (IT); Raffaele Ardito, Milan (IT); Emanuele Bertarelli, Milan (IT); Marco Ferrera, Milan (IT)

(73) Assignee: POLITECNICO DI MILANO, Milan (IT)

( * ) Notice: Subject to any disclaimer, the term of this patent is extended or adjusted under 35 U.S.C. 154(b) by 246 days.

(21) Appl. No.: 15/740,665

(22) PCT Filed: Jul. 1, 2016

(86) PCT No.: PCT/IB2016/053985
§ 371 (c)(1),
(2) Date: Dec. 28, 2017

(87) PCT Pub. No.: WO2017/002094
PCT Pub. Date: Jan. 5, 2017

(65) Prior Publication Data

US 2018/0187668 A1 Jul. 5, 2018

(30) Foreign Application Priority Data

Jul. 2, 2015 (IT) ..... 102015000030182

(51) Int. Cl.
*F04B 43/04* (2006.01)
*F04B 43/02* (2006.01)
(Continued)

(52) U.S. Cl.
CPC ..... *F04B 43/043* (2013.01); *F04B 43/025* (2013.01); *F04B 49/06* (2013.01);
(Continued)

(58) Field of Classification Search
CPC .. F04B 53/102; F04B 53/1072; F04B 43/043; F04B 43/025
See application file for complete search history.

(56) References Cited

U.S. PATENT DOCUMENTS 5,171,132 A * 12/1992 Miyazaki ..... F04B 43/046 417/413.1
5,529,465 A 6/1996 Zengerle et al.
(Continued)

FOREIGN PATENT DOCUMENTS

EP 2479415 * 7/2012
WO WO 2011/107162 9/2011

*Primary Examiner* — Charles G Freay
(74) *Attorney, Agent, or Firm* — Leason Ellis LLP

(57) ABSTRACT

A micropump includes: a pumping chamber, between a first semiconductor substrate and a second semiconductor substrate bonded to each other; an inlet valve, having an inlet shutter element between an inlet passage and the pumping chamber; an outlet valve, having an outlet shutter element between the pumping chamber and an outlet passage; a first recess for housing the inlet shutter element when the inlet valve is in the open configuration, the first recess and the pumping chamber being fluidly coupled; a second recess for housing the outlet shutter element when the outlet valve is in the open configuration, the second recess and the pumping chamber being fluidly decoupled.

13 Claims, 7 Drawing Sheets

(51) Int. Cl.

| | |
|---|---|
| ***F04B 49/06*** | (2006.01) |
| ***F04B 53/10*** | (2006.01) |
| *F04B 45/047* | (2006.01) |
| *F04B 45/04* | (2006.01) |

(52) U.S. Cl.
CPC ..... *F04B 53/1072* (2013.01); *F04B 45/041* (2013.01); *F04B 45/047* (2013.01)

(56) References Cited

U.S. PATENT DOCUMENTS

| | | | | |
|---|---|---|---|---|
| 6,116,863 | A * | 9/2000 | Ahn | F04B 43/043 417/322 |
| 6,390,791 | B1 * | 5/2002 | Maillefer | F04B 43/043 251/129.01 |
| 7,005,078 | B2 * | 2/2006 | Van Lintel | F04B 43/043 216/27 |
| 8,939,165 | B2 * | 1/2015 | Reichenbach | F04B 19/006 137/15.18 |
| 2003/0231967 | A1 * | 12/2003 | Najafi | F04B 43/043 417/322 |
| 2004/0033146 | A1 | 2/2004 | Dai et al. | |
| 2006/0027772 | A1 | 2/2006 | Richter et al. | |
| 2009/0317273 | A1 | 12/2009 | Mcavoy et al. | |
| 2015/0133889 | A1 | 5/2015 | Campagnolo et al. | |

* cited by examiner

MICROPUMP WITH ELECTROSTATIC ACTUATION

CROSS REFERENCE TO RELATED APPLICATIONS

The present application is a U.S. National Phase of International Patent Application PCT/IB2016/053985, filed on Jul. 1, 2016, which claims priority to Italian Application No. 102015000030182, filed on Jul. 2, 2015, each of which is incorporated by reference as if expressly set forth in their respective entireties herein.

TECHNICAL FIELD

The present invention relates to a micropump with electrostatic actuation.

BACKGROUND ART

As is known, manufacturing techniques for semiconductor devices have been successfully exploited also outside the field closely related to microelectronics and for instance they have been used to develop microelectromechanical and microfluidic systems for a number of applications.

The field of fluidics, in particular, has benefited from the possibility of manufacturing miniaturized components, such as micropumps and valves, which allow volumes of liquids in the order of microlitres or smaller to be processed with a very high degree of precision. Thus, devices for ink-jet printing, biomedical devices (for example, insulin pumps), and devices for biochemical analyses (for example, microreactors for amplification and detection of nucleic acids), among others, have been improved.

However, the basic components and microfluidic devices available (micropumps and valves) are still relatively complex and their structure is a limitation to miniaturization, besides entailing non-negligible manufacturing costs. For example, micropumps and valves must be equipped with movable members and electromechanical actuators which, by acting on the movable members, control the movement of the fluids in accordance with the required functions. Generally, the integration of the actuators is rather difficult and complicates the manufacturing processes. In fact, the actuators normally require dedicated structures, which must often be made from specially designated structural layers. Furthermore, the actuators employ special materials, such as piezoelectric or magnetic materials, which require changes to the most common manufacturing processes and additional processing steps (for example, deposition, masking, and photolithographic definition of layers of special materials).

It must also be considered that in many cases the tightness of the valves, especially when integrated into membrane micropumps, is not optimal and can be the cause of leakage and backflow, which affect the working of the device.

DISCLOSURE OF INVENTION

The object of the present invention is to provide a micropump that makes it possible to overcome or at least mitigate the limitations described above.

According to the present invention, there is provided a micropump comprising:

a pumping chamber, between a first semiconductor substrate and a second semiconductor substrate bonded to each other;

an inlet valve, having an inlet shutter element between an inlet passage and the pumping chamber;

an outlet valve, having an outlet shutter element between the pumping chamber and an outlet passage;

a first recess for housing the inlet shutter element when the inlet valve is in the open configuration, the first recess and the pumping chamber being fluidly coupled;

a second recess for housing the outlet shutter element when the outlet valve is in the open configuration, the second recess and the pumping chamber being fluidly decoupled.

The configuration of the inlet and outlet valves, with the first recess communicating with the pumping chamber and the second recess decoupled from it, allows the direction of the processed flow to be controlled in a completely passive way. More precisely, the inlet and outlet valves do not require dedicated actuators and so the structure is generally simplified, for the benefit of both the overall dimensions and the manufacturing costs. For instance, the micropump as just defined may be made from just two semiconductor wafers joined together. Moreover, the micropump control is simplified because it does not have to take into account the synchronization of the valves. Dedicated actuators for the valves, in particular for the output valve, may optionally be provided if specific circumstances make this advisable. However, the micropump is still fully operative even with purely passive valves.

According to a further aspect of the invention, the inlet valve and the outlet valve are of the orthoplanar type.

Valves of this type are effective, they have a good seal and they lend themselves to be integrated into the manufacturing processes for semiconductor microelectromechanical systems.

According to another aspect of the invention, the micropump comprises:

a first pumping membrane made of semiconductor material and delimiting the pumping chamber on a first side;

a first electrode structure, capacitively coupled to the first pumping membrane and configured to apply a first electrostatic force to the first pumping membrane in the presence of a first actuating voltage between the first electrode structure and the first pumping membrane; and a control unit configured to apply the first actuating voltage in the form of a frequency-controlled periodic wave.

The use of a pumping membrane made of semiconductor material and of a capacitively coupled electrode structure makes it possible to efficiently exploit an actuation mechanism based on electrostatic forces. In particular, it is advantageous that the electrode structure may be made for example of polysilicon, and thus be easily integrated into the manufacturing processes for semiconductor microelectromechanical devices without the need to use special materials, such as magnetic or piezoelectric materials.

According to a further aspect of the invention, the micropump comprises a third recess delimited on one side by the first pumping membrane and fluidly decoupled from the pumping chamber, the first electrode structure being arranged on a wall of the third recess opposite to the first pumping membrane and configured to retract the first pumping membrane within the third recess.

In this way, the space occupied by the first electrode structure is really negligible and its provision has no appreciable effect on the manufacturing processes.

According to another aspect of the invention, the micropump comprises:

a second pumping membrane made of semiconductor material and delimiting the pumping chamber on a second side opposite to the first side; and a second electrode structure capacitively coupled to the second pumping membrane and configured to apply a second electrostatic force to the second pumping membrane in response to a second actuating voltage between the second electrode structure and the second pumping membrane;

the control unit being configured to supply the second actuating voltage in the form of a periodic wave with a controlled frequency equal to the frequency of the first actuating voltage.

The use of two opposing membranes advantageously makes it possible to increase the volume of fluid that can be processed in each pumping cycle and, therefore, to increase the maximum flow rate of the micropump.

BRIEF DESCRIPTION OF THE DRAWINGS

For a better understanding of the invention, an embodiment thereof will now be described, purely by way of non limiting example and with reference to the accompanying drawings, wherein.

BEST MODE FOR CARRYING OUT THE INVENTION

Figure 1:
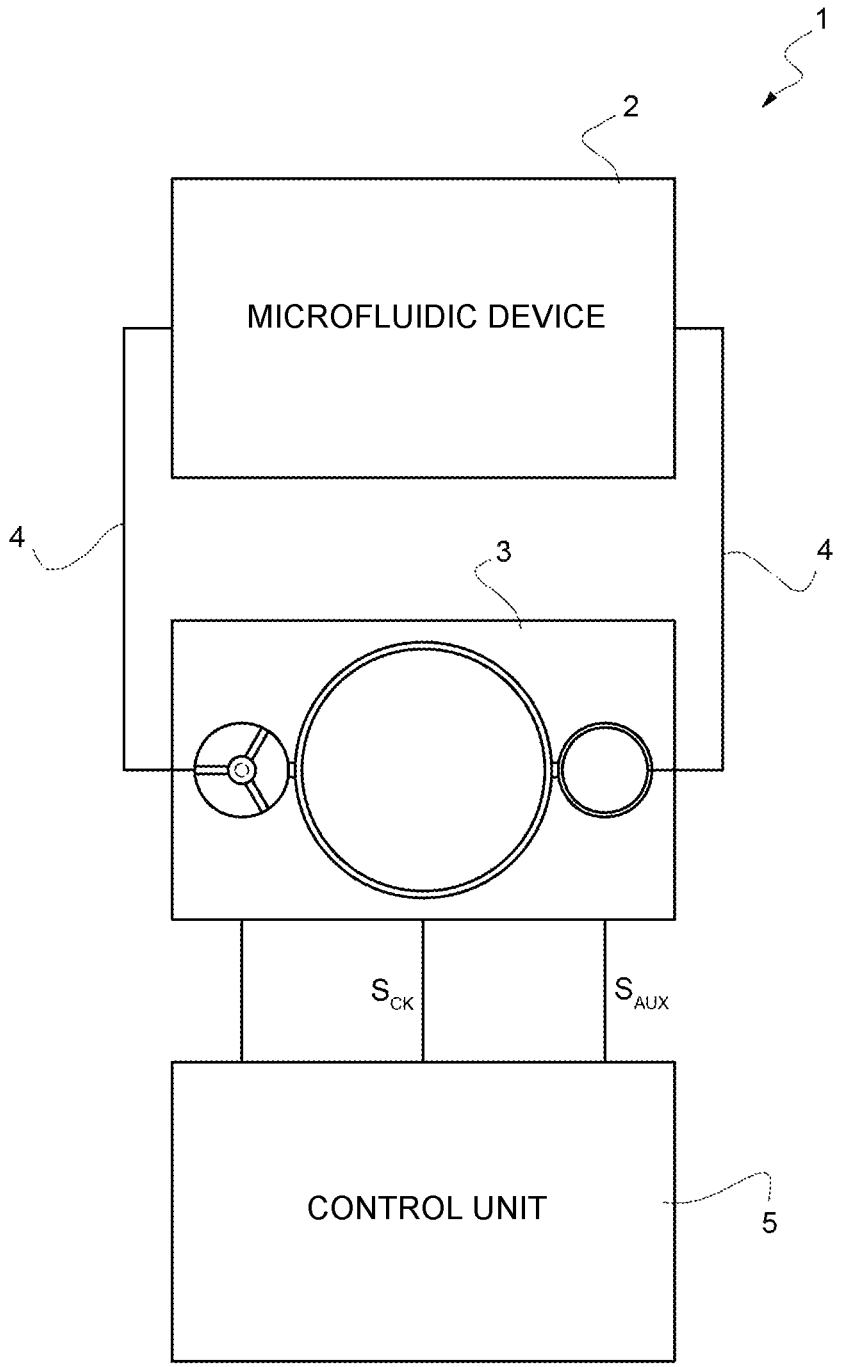
FIG. 1 is a simplified block diagram of a microfluidic system incorporating a micropump according to one embodiment of the present invention.

Referring to FIG. 1, a microfluidic system is indicated as a whole with number 1 and comprises a microfluidic device 2, a micropump 3 coupled to the microfluidic device 2 through fluid connection lines 4, and a control unit 5.

The microfluidic device 2 may be any device that processes and/or dispenses a controlled volume of fluid, typically in the order of microlitres or nanolitres. To mention a few non-limiting examples, the microfluidic device 2 may include an ink-jet print head, an infusion pump dispenser for the continuous administration of drugs, or a device for the amplification and detection of nucleic acids in a biological sample. The components of the microfluidic system 1 may be provided on respective separate carriers or be integrated, all or in part, into a single carrier, including for example a semiconductor substrate.

The control unit 5 controls the micropump 3 by means of one or more pumping control signals $S_{CK}$ and auxiliary control signals $S_{AUX}$ so that the micropump 3 transfers to the microfluidic device 2 a controlled fluid flow rate through the fluid connection lines 4, as required by the functions of said microfluidic device 2. In one embodiment, the pumping control signals $S_{CK}$ may be in the form of periodic voltages, for example a square wave voltage, with a frequency controlled as a function of the fluid flow rate to be supplied to the microfluidic device 2.

According to one embodiment of the present invention, referred to in FIGS. 2-5, the micropump 3 comprises a first semiconductor substrate 7 and a second semiconductor substrate 8 joined together by a bonding layer 9. Here and hereinafter, "semiconductor substrate" is intended to mean a structure obtained by the processing of a wafer of semiconductor material essentially by manufacturing techniques for electronic and semiconductor microelectromechanical devices. In particular, it is to be understood that each semiconductor substrate may comprise several layers and/or structures of semiconductor material, with respective doping types and levels, and, in addition, layers and/or structures of materials different from semiconductors, including dielectric materials.

For example, in the embodiment of FIGS. 2-5, the first semiconductor substrate 7 comprises a first carrier layer 10 made of monocrystalline silicon and a first structural layer 11 made of polycrystalline silicon, which are mechanically connected to each other and electrically isolated from one another by a first dielectric layer 12, for example of silicon oxide.

Similarly, the second semiconductor substrate 8 comprises a second carrier layer 15 made of monocrystalline silicon and a second structural layer 16 made of polycrystalline silicon, which are mechanically connected to each other and electrically isolated from one another by a second silicon oxide dielectric layer 17.

The micropump 3 further comprises an inlet passage 18, an outlet passage 19, a pumping chamber 20, an inlet valve 21, an outlet valve 22, a main actuator 25, and an auxiliary actuator 26.

In one embodiment, the inlet passage 18 and the outlet passage 19 are both formed through the second semiconductor substrate 8 for connecting the pumping chamber 20 with the fluid connection lines 4, not shown here. In one embodiment, the inlet passage 18 and the outlet passage 19 extend perpendicularly to a main surface of the second semiconductor substrate 8 and to the pumping chamber 20.

The pumping chamber 20 is defined between the first semiconductor substrate 7 and the second semiconductor substrate 8, and the inlet valve 21 and outlet valve 22 allow the pumping chamber 20 to be fluidly coupled with the inlet passage 18 and the outlet passage 19, respectively.

In more detail, the inlet valve 21 is of the orthoplanar type and has an inlet shutter element 27 between the inlet passage 18 and the pumping chamber 20. A first recess 28 in the first substrate 7 houses at least one portion of the inlet shutter element 27 when the inlet valve 21 is in the open configuration. In one embodiment, the first recess 28 is defined by an interruption in the first dielectric layer 12.

The inlet shutter element 27 is connected to the first structural layer 11 of the first substrate 7 by elastic suspension elements 30, also made of polycrystalline silicon, which extend in a transverse direction with respect to a direction of movement of the inlet shutter element 27. Fluid passages 29 are defined between the elastic suspension elements 30 and fluidly couple the first recess 28 with the pumping chamber 20. Therefore, the first recess 28 and the pumping chamber are substantially at the same pressure.

The inlet shutter element 27 is maintained against the second substrate 8 by the elastic suspension elements 30, closing the inlet passage 18, with a preload force. The inlet shutter element 27 is provided with a spacer 32, whose thickness determines the state of tension of the elastic suspension elements 30 and, consequently, the preload force with which the inlet shutter element 27 is maintained for the closure of the inlet passage 18. As long as the pressure difference between the inlet passage 18 and the pumping chamber 20 is lower than a first pressure threshold, the preload force prevails and the inlet valve 21 remains closed. When the first pressure threshold is exceeded, the inlet shutter element 27 retracts into the first recess 30 and the inlet valve 21 opens. In one embodiment, the inlet shutter element 27 is movable along a longitudinal axis of the inlet passage 18.

The outlet valve 22, also of the orthoplanar type, has an outlet shutter element 33 between the outlet passage 19 and the pumping chamber 20. A second recess 35 houses at least one portion of the outlet shutter element 33 when the outlet valve 22 is in the open configuration, the second recess and the pumping chamber being fluidly decoupled.

The outlet shutter element 33 is connected to the second structural layer 16 of the second substrate 8 by means of an elastic valve membrane 36, which delimits the second recess 35 on one side and is continuous. The second recess 35 is therefore fluidly decoupled from the pumping chamber 20 by means of the valve membrane 36. In one embodiment, in particular, the second recess 35 is sealed.

The outlet shutter element 33 is maintained against the second substrate 8 by the valve membrane 36, closing the outlet passage 19, with a preload force. The outlet shutter element 33 is provided with a spacer 37, whose thickness determines the state of tension of the valve membrane 36 and, consequently, the preload force with which the outlet shutter element 33 is maintained for the closure of the outlet passage 19. As long as the pressure difference between the pumping chamber 20 and the outlet passage 19 is lower than a second pressure threshold, the preload force prevails and the outlet valve 22 remains closed. When the second pressure threshold is exceeded, the outlet shutter element 33 retracts into the second recess 35 and the outlet valve 22 opens. In one embodiment, the second pressure threshold is greater than the first pressure threshold. Thanks to the preload force, any unwanted backflows toward the pumping chamber from the fluid connection line 4 connected to the outlet passage 19 may be eliminated or at least reduced. In one embodiment, the outlet shutter element 33 is movable along a longitudinal axis of the outlet passage 19.

The main actuator 25 comprises a first pumping membrane 40, a second pumping membrane 41, a first electrode structure 42, and a second electrode structure 43.

The first pumping membrane 40 and the second pumping membrane 41, made of polycrystalline silicon and substantially circular, are respectively connected to the first structural layer 11 of the first substrate 7 and to the second structural layer 16 of the second substrate 8, and they delimit the pumping chamber 20, each on a respective side.

A third recess 45 is formed in the first substrate 7 and is delimited on one side by the first pumping membrane 40. A fourth recess 46 is formed in the second substrate 8 and is delimited on one side by the second pumping membrane 41.

The first pumping membrane 40 and the second pumping membrane 41 are continuous and therefore fluidly decouple the pumping chamber 20 from the third recess 45 and from the fourth recess 46.

Figure 2:
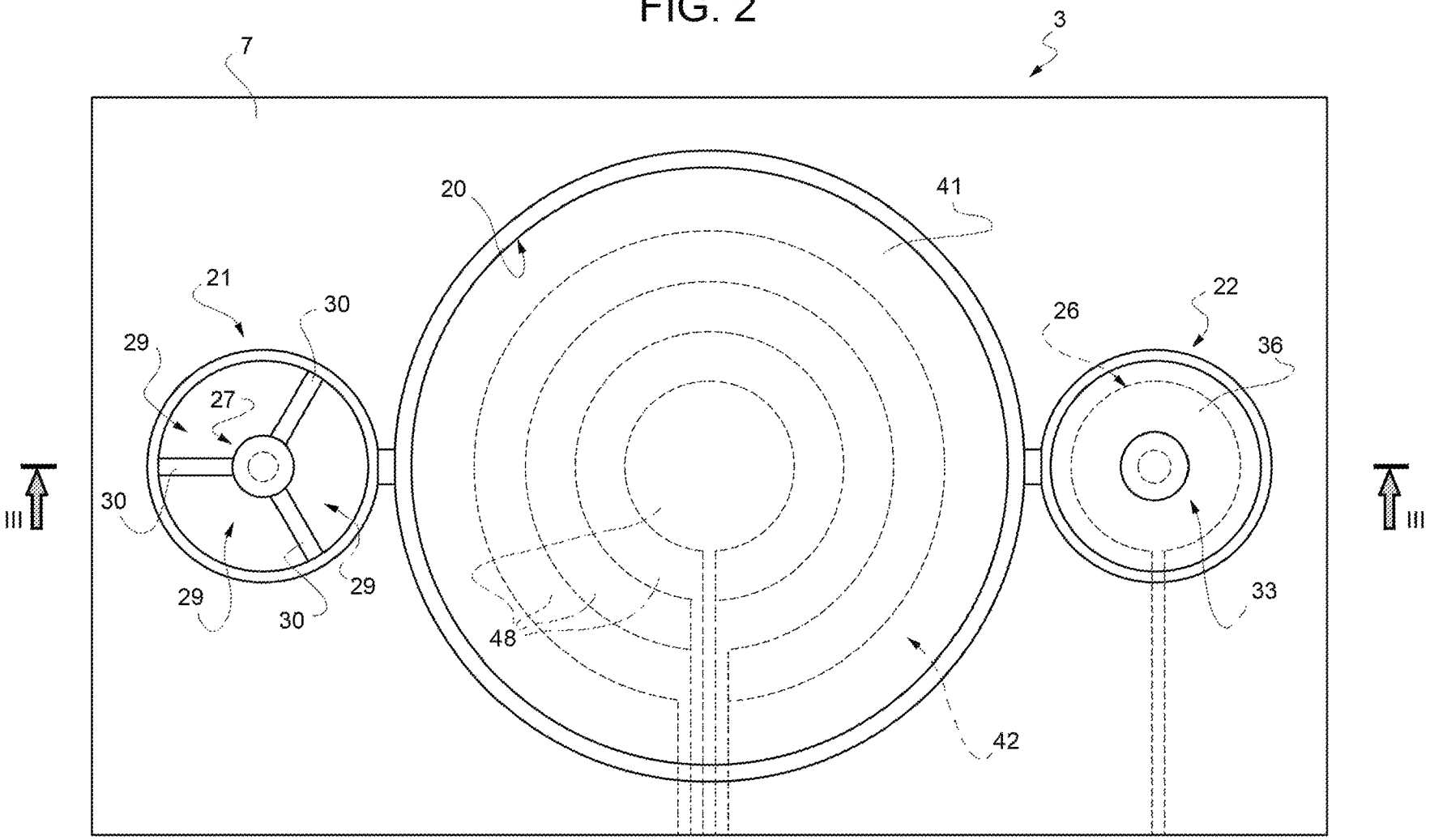
FIG. 2 is a bottom plan view, with parts removed for clarity, of the micropump of FIG. 1.
Figure 3:
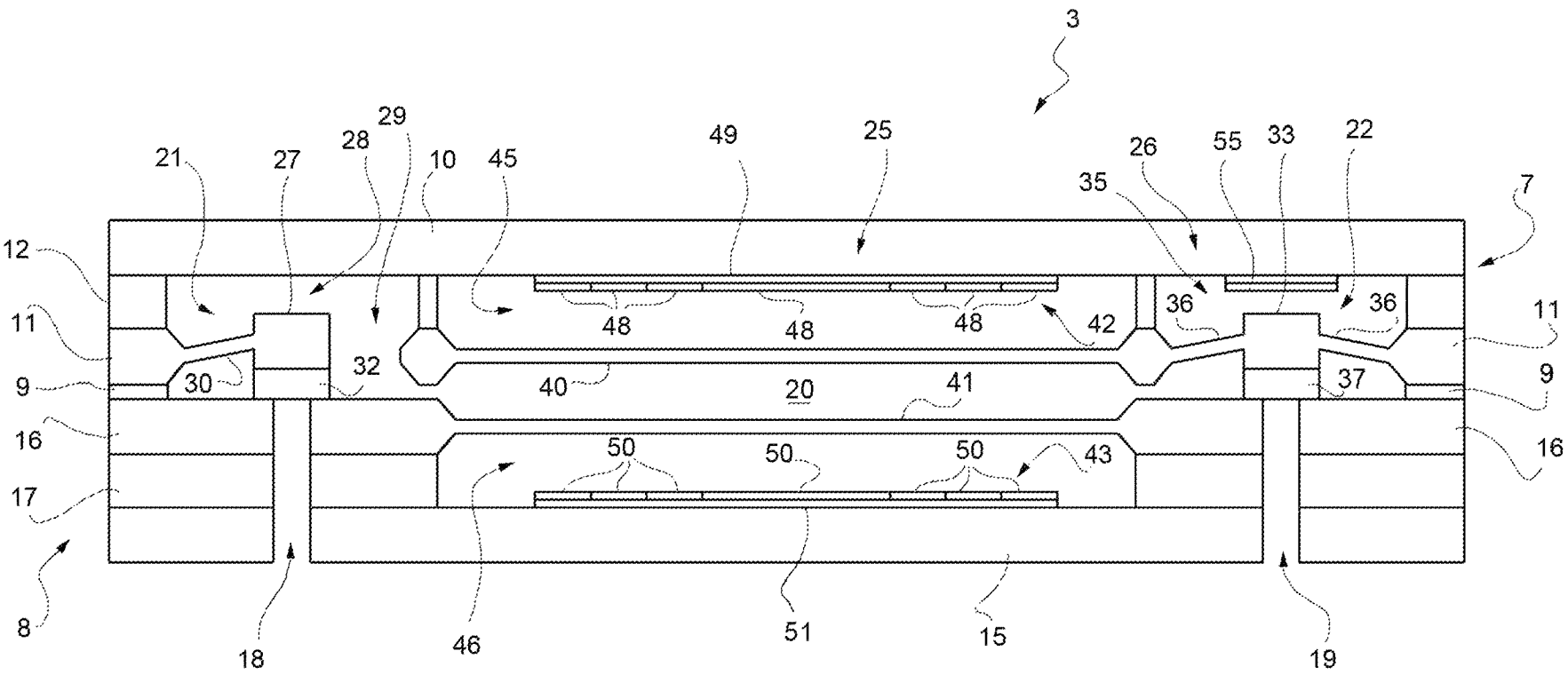
FIG. 3 is a cross section, taken along the plane III-III of FIG. 2, of the micropump of FIG. 2 in a resting configuration.
Figure 4:
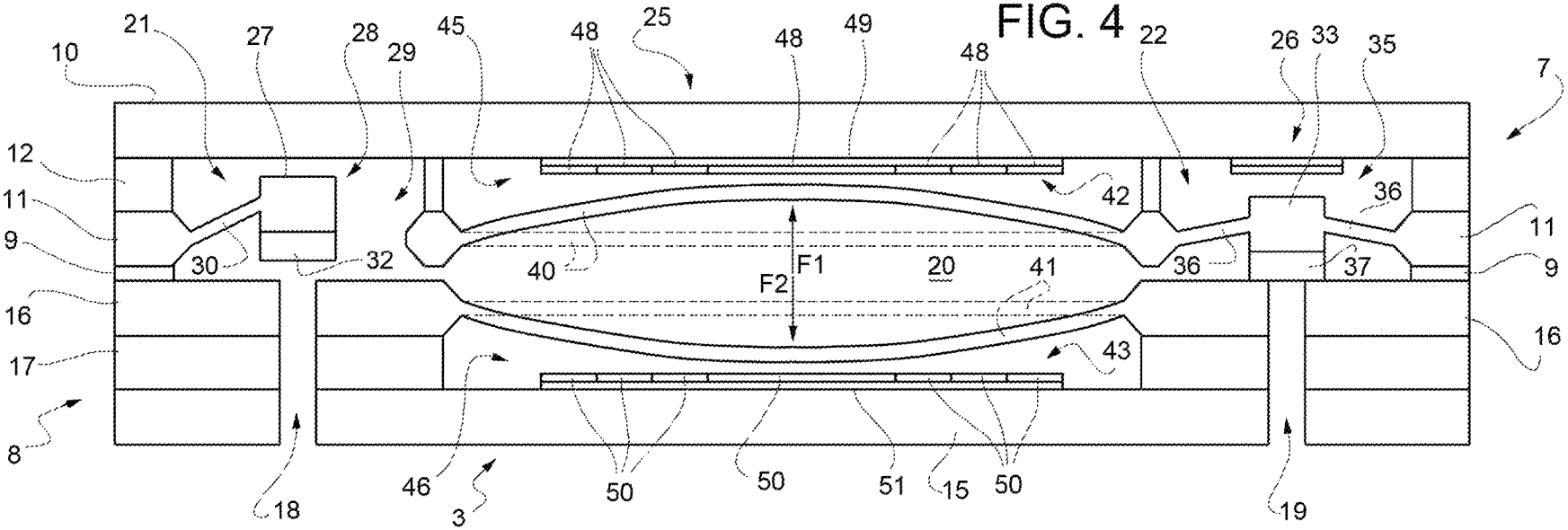
FIG. 4 shows the same view as FIG. 3, with the micropump in a first operating configuration.
Figure 5:
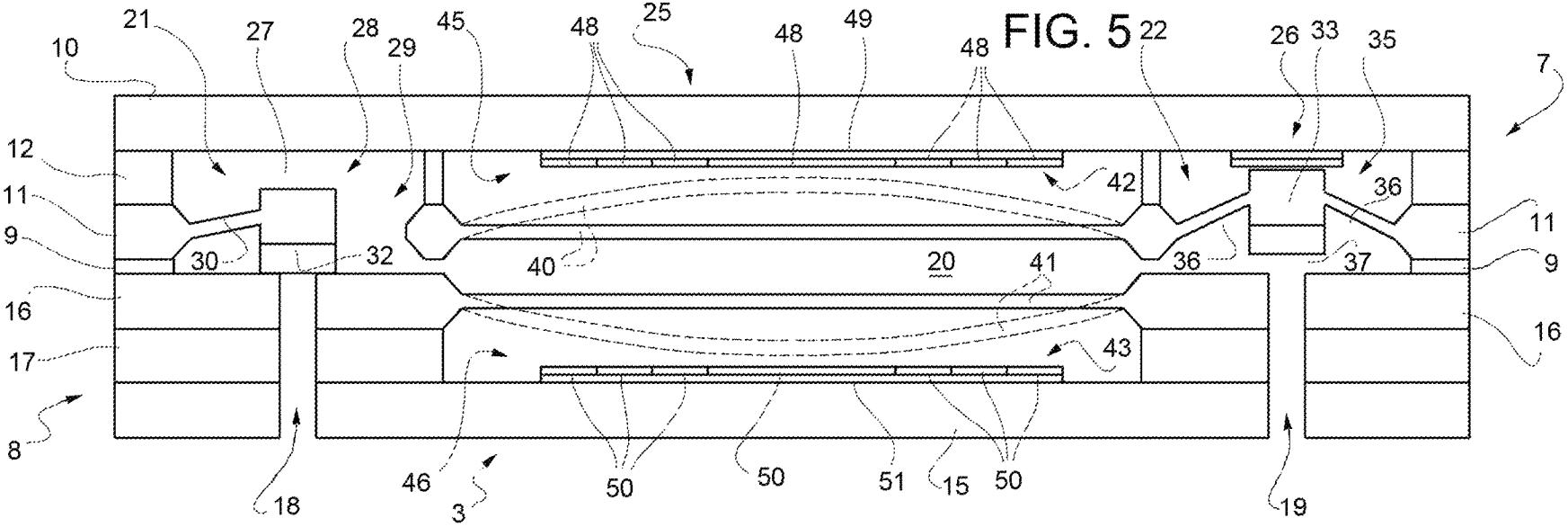
FIG. 5 shows the same view as FIG. 3, with the micropump in a second operating configuration.
Figure 6:
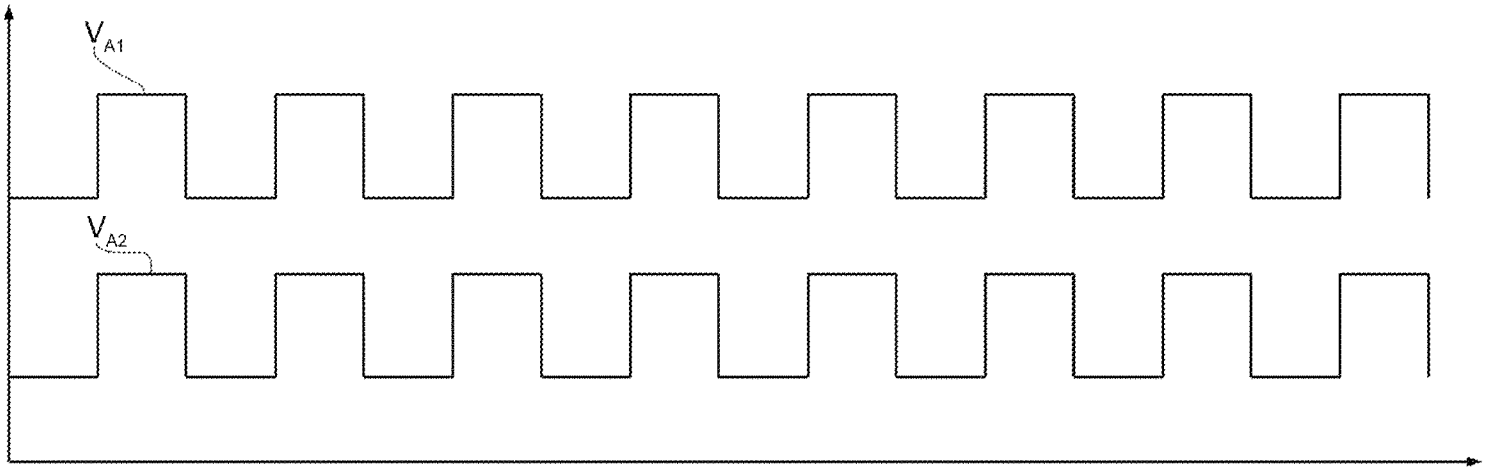
FIG. 6 is a graph illustrating electrical quantities related to the micropump of FIG. 2.

The first electrode structure 42 is located on a wall of the third recess 45 opposite to the first pumping membrane 40 and, in one embodiment, it comprises a plurality of concentric annular first electrodes 48 (see particularly FIG. 2). A dielectric layer 49 isolates the first electrode structure 42 from the first structural layer 11 of the first substrate 7, which defines the wall of the third recess 45. The first electrode structure 42 is capacitively coupled to the first pumping membrane 40 and it applies a first electrostatic force $F_1$ (FIG. 3) to the first pumping membrane 40 in the presence of a first actuating voltage $V_{A1}$ (FIG. 6) between the first electrode structure 42 and the first pumping membrane 40. The first electrostatic force $F_1$ retracts the first pumping membrane 40 towards the third recess 45, helping to create a negative pressure inside the pumping chamber 20. When the first electrostatic force $F_1$ is removed, the first pumping membrane 40 returns to its resting configuration and determines a compression in the pumping chamber 20.

The first actuating voltage $V_{A1}$ is determined by one or more of the pumping control signals $S_{CK}$ provided by the control unit 5 and it may be in the form of periodic voltages, for example a square wave voltage, with a frequency controlled as a function of the fluid flow rate to be supplied to the microfluidic device 2. In one embodiment, the first electrodes 48 are all biased to the first actuating voltage $V_{A1}$. In a different embodiment, however, the first electrodes 48 may receive actuating voltages of the same frequency, but different for example in amplitude and duty-cycle, so as to obtain a different distribution of the first actuating force along the first pumping membrane 40.

The second electrode structure 43 is located on a wall of the fourth recess 46 opposite to the second pumping membrane 41 and, in one embodiment, it comprises a plurality of concentric annular second electrodes 50, substantially formed symmetrically to the first electrodes 48. A dielectric layer 51 isolates the second electrode structure 43 from the second carrier layer 15 of the second substrate 8, which defines the wall of the fourth recess 46. The second electrode structure 43 is capacitively coupled to the second pumping membrane 41 and it applies a second electrostatic force $F_2$ (FIG. 3) to the second pumping membrane 41 in the presence of a second actuating voltage $V_{A2}$ (FIG. 6) between the second electrode structure 43 and the second pumping membrane 41. The second electrostatic force $F_2$ retracts the second pumping membrane 41 towards the fourth recess 46, creating a negative pressure inside the pumping chamber 20. When the second electrostatic force $F_2$ is removed, the second pumping membrane 41 returns to its resting configuration and determines a compression in the pumping chamber 20.

The second actuating voltage $V_{A2}$ is determined by one or more of the pumping control signals $S_{CK}$ provided by the control unit 5 and it may be in the form of periodic voltages, for example a square wave voltage, with a frequency controlled as a function of the fluid flow rate to be supplied to the microfluidic device 2. Like the first electrodes 48, the second electrodes 50 may all be biased to the second actuating voltage $V_{A2}$ or they may receive respective actuating voltages of the same frequency, but different for example in amplitude and duty-cycle, so as to obtain a different distribution of the second actuating force along the second pumping membrane 41.

The actuating voltages applied to the first pumping membrane 40 and to the second pumping membrane 41 still have the same frequency and are synchronized so as to optimize the pumping effect, coordinating the deflection of the first pumping membrane 40 and of the second pumping membrane 41. The frequency may be varied depending on the desired flow rate.

The auxiliary actuator 26 comprises an auxiliary electrode structure 55, arranged on a wall of the second recess 35 opposite to the outlet shutter element 33 and to the valve membrane 36. The auxiliary electrode structure 55 is capacitively coupled to the outlet shutter element 33 and to the valve membrane 36. In the presence of an auxiliary actuating voltage between the auxiliary electrode structure 55 on one side and the outlet shutter element 33 and the valve membrane 36 on the other side, the auxiliary electrode structure 55 applies an auxiliary electrostatic force that helps the opening of the outlet valve. The auxiliary actuating voltage may be determined by the auxiliary control signals $S_{AUX}$ supplied by the control unit 5.

The micropump 3 is operated by the control unit 5 through the actuating control signals $S_{CK}$, following which the actuating voltages $V_{A1}$, $V_{A2}$ are produced, and, optionally, through the auxiliary control signals $S_{AUX}$. In the active phase of each period of the actuating voltages $V_{A1}$, $V_{A2}$, the first pumping membrane 40 and the second pumping membrane 41 will deform due to the effect of the electrostatic forces $F_1$, $F_2$ (FIG. 4) and they retract inside the third recess 45 and the fourth recess 46, respectively, causing a negative pressure within the pumping chamber 20. The pressure difference between the inlet passage 18 and the pumping chamber 20 prevails over the preload force on the inlet shutter element 27 and the inlet valve 21 opens, allowing for the loading of the pumping chamber 20. The inlet valve 21 closes again when the pressure difference between the inlet passage 18 and the pumping chamber 20 drops below the first pressure threshold.

Instead, the outlet valve 22 remains closed, both because of the higher preload force due to the action of the valve membrane 36, also by reason of the thickness of the spacer 37, and because of the back pressure of the gaseous fluid present in the second recess 35, which is sealed (or at least fluidly decoupled from the pumping chamber 20).

When the electrostatic forces $F_1$, $F_2$ are removed (inactive phase of the period of the actuating voltages $V_{A1}$, $V_{A2}$), the first pumping membrane 40 and the second pumping membrane 41 return to their respective resting configurations (FIG. 5), compressing the fluid in the pumping chamber 20. The increase in the pressure has no influence on the inlet valve 21, since the first recess 28 is fluidly coupled to the pumping chamber 20 through the fluid passages 29 between the elastic suspension elements 30.

Instead, the second recess 35 is decoupled from the pumping chamber 20 by means of the valve membrane 36. The compression produced by the return movement of the first pumping membrane 40 and of the second pumping membrane 41 then causes an imbalance between the faces of the valve membrane 36, which tends to open the outlet valve 22. When the pressure difference between the pumping chamber 20 and the outlet passage 19 exceeds the second pressure threshold, the outlet shutter element 33 detaches from the second substrate 8 and the outlet valve 22 is actually open.

Like the inlet valve 21, also the outlet valve 22 may therefore operate in a completely passive way, without the need for external controls. However, in an initial working phase, it may be useful to control the opening of the outlet valve 22 by the auxiliary actuator 26 and the auxiliary control signals $S_{AUX}$ to facilitate the filling of the pumping chamber 20. In particular, during the initial loading (priming) of the working fluid, the outlet valve 22 may be kept open by the auxiliary actuator 26 to favour the evacuation of the air initially present and to avoid the formation of gas bubbles that may affect the functionality of the micropump 3. The possibility of controlling the opening of the outlet valve 22 is thus particularly advantageous to facilitate the initial filling of the microfluidic device 2.

The above-described micropump advantageously has a simplified structure, which in particular benefits from inlet and outlet valves that can be used in a completely passive way. Therefore, no specific control is required. An auxiliary electrostatic actuator for the outlet valve can be provided if necessary to facilitate functioning under particular transient conditions, but as a rule it is unnecessary under normal operating conditions.

The structure is simplified to the point that the micropump can be manufactured from just two semiconductor wafers, from which the first substrate and the second substrate are derived.

The presence of membrane electrostatic actuators also contributes to this, both through the pumping chamber, and, possibly, through the outlet valve. In fact, the electrode structures of the actuators are housed in the recesses between the carrier layers and the respective membranes. Moreover, the manufacture thereof is perfectly compatible with the techniques normally used in the production of microelectromechanical devices. Techniques for making membranes are, in fact, known and may comprise, for example, growing a structural layer from the seed layer before forming a sacrificial layer on a semiconductor substrate and thus, after depositing a seed layer on the sacrificial layer. The structural layer may be selectively etched by a photolithographic process for opening trenches through regions dedicated to the formation of the membranes. The sacrificial layer may then be removed by etching through the trenches, which may then be closed, for example, by an annealing process (i.e. a high temperature processing in the presence of hydrogen which allows the semiconductor material to be redistributed, making the structure more homogeneous). The annealing process restores the continuity of the semiconductor material in the regions corresponding to the membranes. The electrode structures of the actuators can be easily incorporated into the sacrificial layer during the initial steps of the process. After forming an insulating layer, for example silicon oxide, the electrode structures may be made by photolithographically defining a polysilicon layer deposited on the insulating layer. The sacrificial layer, also of silicon oxide, may then be deposited so as to incorporate the electrode structures. During the removal of the sacrificial layer, the electrode structures themselves protect the underlying portions of the insulating layer, which are spared and subsequently serve as anchors. The use of covering sheets of the dry film type may be contemplated for membrane impermeabilization.

A further advantage of the above-described membrane actuators is given by the fact that, thanks to the arrangement of the electrode structures with respect to the membranes, the pumping chamber is not affected by the electric fields that determine the pumping effect. For this reason, the micropump according to the invention may be used with no drawbacks even when the fluid to be circulated is an ionic solution.

The micropump has an essentially planar structure and may have inlet and outlet passages on the same face. This is generally considered to be advantageous because the structure of the fluidic circuit connected to the micropump can be simplified.

Figure 7:
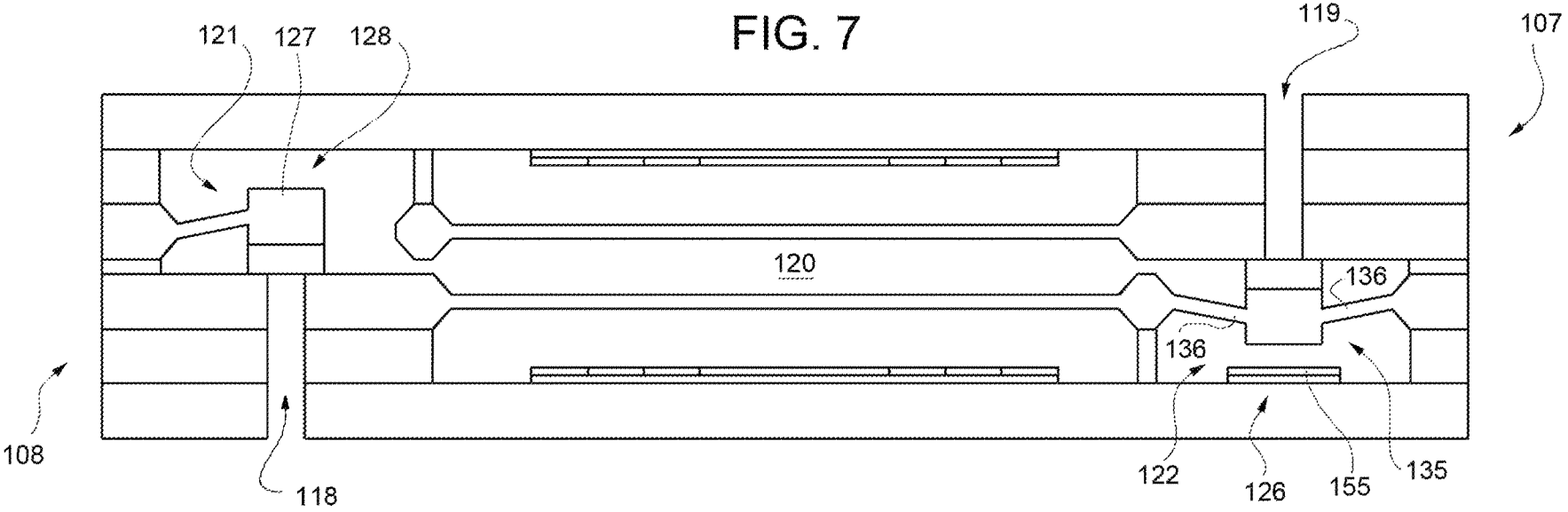
FIG. 7 is a cross section of a micropump according to another embodiment of the present invention.

However, this structure is not mandatory. For example, in the embodiment of FIG. 7, an outlet passage, designated here by 119, is made through the first substrate 107. In this case, as previously described, the moving parts of the inlet valve 121 are integrated into the first substrate 107, while the inlet passage 118 is formed in the second substrate 108. A first recess 128, defined in the first substrate 107, receives the inlet shutter element 127 when the inlet valve 121 is open and fluidly coupled to the pumping chamber 120. Instead, the outlet valve 122 and the auxiliary actuator 126 are incorporated into the second substrate 108. In particular, the outlet valve 122 comprises an outlet shutter element 133, which closes the outlet passage 119 and is connected to the second structural layer 116 of the second substrate 108 through a valve membrane 136. A second recess 135, defined in the second substrate 108 and fluidly decoupled from the pumping chamber 120 by the valve membrane 136, receives the outlet shutter element 133 when the outlet valve 122 is open. The auxiliary electrode structure 155 of the auxiliary actuator 126 is located on a wall of the second recess 135 opposite to the valve membrane 136 and capacitively coupled thereto.

The presence of two opposing pumping membranes is also generally advantageous, although not strictly necessary.

Figure 8:
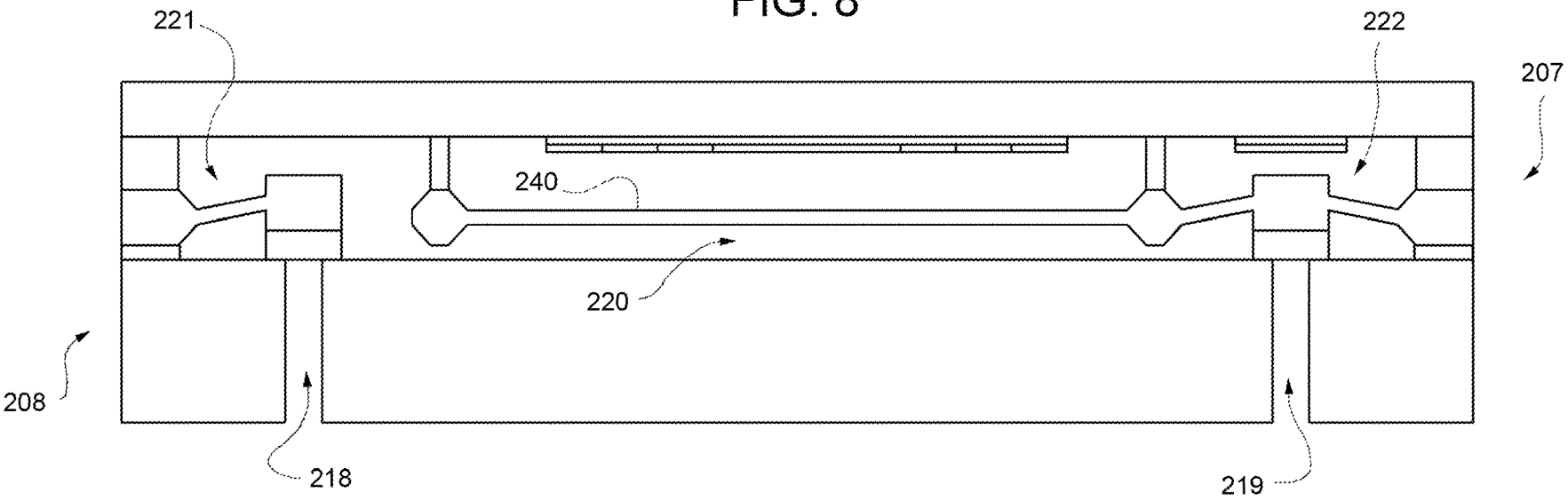
FIG. 8 is a cross section of a micropump according to a further embodiment of the present invention.

In the embodiment shown in FIG. 8, for example, there is a single pumping membrane 240 in the same first substrate 207 into which the moving parts of the inlet valve 221 and of the outlet valve 222 are integrated. In this case, the second substrate 208 may purely serve as a carrier and a delimitation of the pumping chamber 220, in addition to being the site of the inlet passage 218 and of the outlet passage 219.

Figure 9:
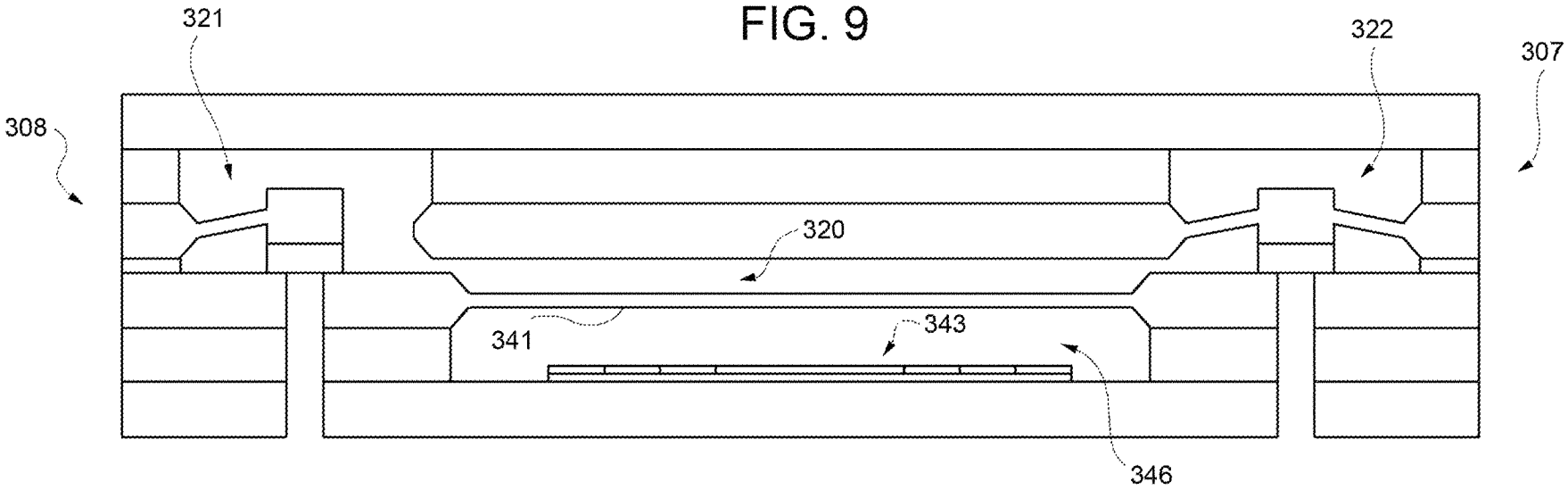
FIG. 9 is a cross section of a micropump according to a further embodiment of the present invention.

In the embodiment of FIG. 9, the moving parts of the inlet valve 321 and of the outlet valve 322 are integrated into the first substrate 307, while the single pumping membrane 341 present is integrated into the second substrate 308. On the opposite side, the pumping chamber 320 is bounded by the first substrate 307. In this case, a recess 346 is formed in the second substrate 308 and is bounded on one side by the pumping membrane 341. The electrode structure 343 is located on a wall of the recess 346 opposite to the second pumping membrane 341.

Figure 10:
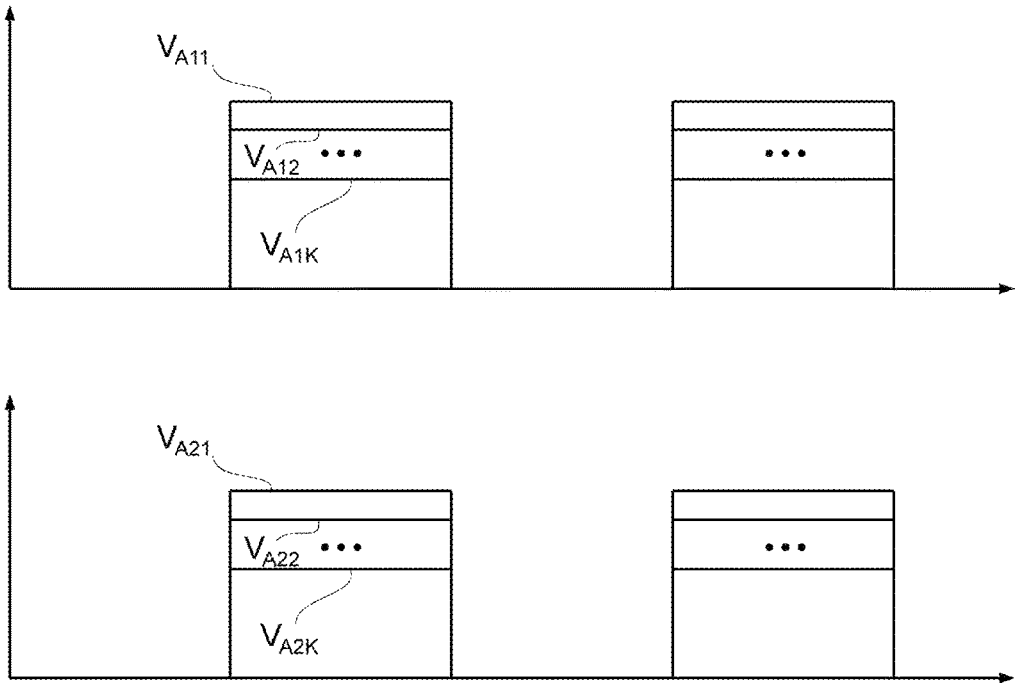
FIG. 10 is a graph illustrating electrical quantities related to a micropump according to another embodiment of the present invention.

As already mentioned with reference to FIGS. 2-5, in one embodiment, the electrodes of each actuating structure may receive actuating voltages of the same frequency, but different, for example, in amplitude and/or duty-cycle, so as to optimize the working of the micropump 1 by controlling the distribution of the actuating forces along the pumping membranes. FIG. 10 illustrates an example, also related to the structure of FIGS. 2-5, wherein the first electrodes 48 of the first electrode structure 42 receive respective actuating voltages $V_{A11}, \ldots, V_{A1K}$ different in amplitude (in the example, K first electrodes 48 are deemed to be present; index 1 refers to the first most external electrode 48 and index K refers to the first central electrode 48). The second electrodes 50 of the second electrode structure 43 receive respective actuating voltages $V_{A21}, \ldots, V_{A2K}$ equal to the corresponding actuating voltages $V_{A11}, \ldots, V_{A1K}$.

Figure 11:
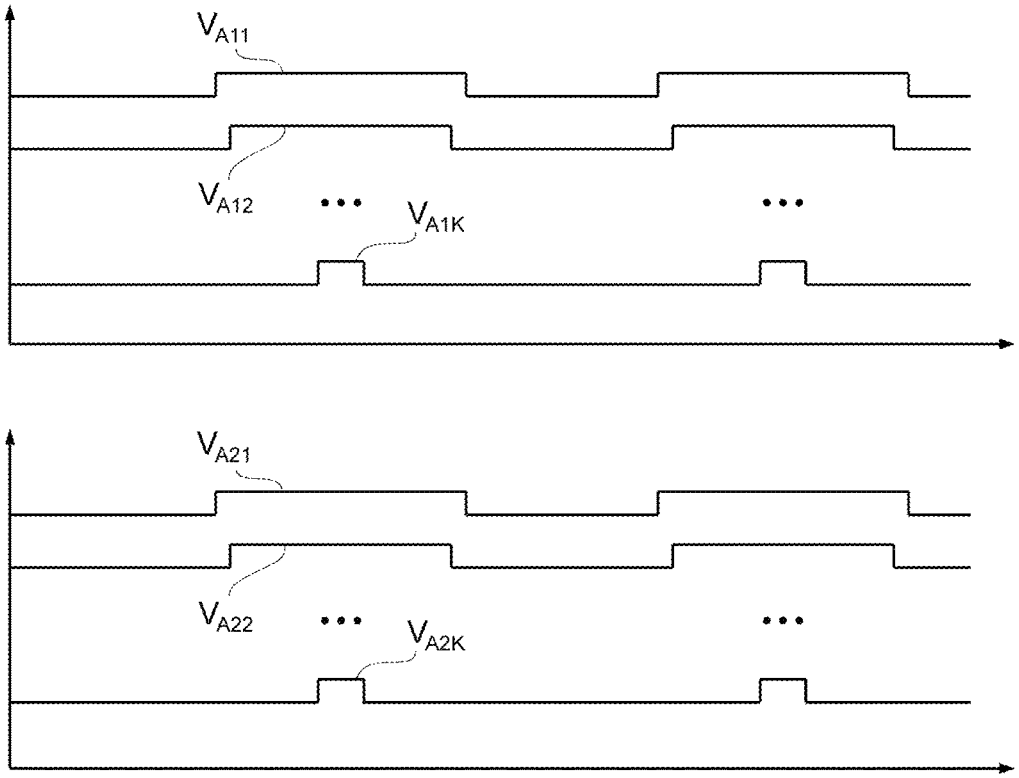
FIG. 11 is a graph illustrating electrical quantities related to a micropump according to a further embodiment of the present invention.

In the example of FIG. 11, the actuating voltages $V_{A11}, \ldots, V_{A1K}$ and the actuating voltages $V_{A21}, \ldots, V_{A2K}$ differ in duty-cycle. Obviously, it is possible to envisage the use of actuating voltages different both in amplitude and in duty-cycle.

Lastly, it is evident that the micropump described can be subject to modifications and variations without departing from the scope of the present invention, as defined in the appended claims.

The invention claimed is:

1. A micropump comprising:

a first semiconductor substrate, including a first carrier layer made of monocrystalline silicon and a first structural layer made of polycrystalline silicon, the first carrier layer and the first structural layer being mechanically connected to each other and electrically isolated from one another by a first dielectric layer;

a second semiconductor substrate including a second carrier layer made of monocrystalline silicon and a second structural layer made of polycrystalline silicon, the second carrier layer and the second structural layer being mechanically connected to each other and electrically isolated from one another by a second silicon oxide dielectric layer, the first semiconductor substrate and the second semiconductor substrate being bonded to each other;

a pumping chamber, between the first semiconductor substrate and the second semiconductor substrate;

an inlet valve, having an inlet shutter element between an inlet passage and the pumping chamber, the inlet shutter element being connected to one of the first structural layer of the first semiconductor substrate and the second structural layer of the second semiconductor substrate by elastic suspension elements made of semiconductor material, extending in a transverse direction with respect to a direction of movement of the inlet shutter element;

an outlet valve, having an outlet shutter element between the pumping chamber and an outlet passage;

a first recess fluidly coupled to the pumping chamber and configured to house the inlet shutter element when the inlet valve is in an open configuration, the first recess being defined by a first interruption in one of the first dielectric layer and the second dielectric layer and delimited by the corresponding first carrier layer or second carrier layer;

a second recess fluidly decoupled from the pumping chamber and configured to house the outlet shutter element when the outlet valve is in an open configuration, the second recess being defined by a second interruption in one of the first dielectric layer and the second dielectric layer and delimited by the corresponding first carrier layer or second carrier layer; and fluid passages defined between the elastic suspension elements, the first recess being fluidly coupled to the pumping chamber through the fluid passages;

wherein the outlet shutter element is connected to the first semiconductor substrate by an elastic valve membrane and the second recess is fluidly decoupled from the pumping chamber by the valve membrane.

2. A micropump according to claim 1, wherein the inlet passage is obtained in one of the first semiconductor substrate or the second semiconductor substrate and the inlet shutter element is connected to the other one of the first semiconductor substrate or the second semiconductor substrate; and the outlet passage is obtained in one of the first semiconductor substrate or the second semiconductor substrate and the outlet shutter element is connected to the other one of the first semiconductor substrate or the second semiconductor substrate.

3. A micropump according to claim 1, wherein the inlet passage and the outlet passage are made either both in the first semiconductor substrate or both in the second semiconductor substrate.

4. A micropump according to claim 1, wherein the inlet passage and the outlet passage extend perpendicularly to the pumping chamber.

5. A micropump according to claim 1, wherein the inlet valve and the outlet valve are of the orthoplanar type.

6. A micropump according to claim 1, wherein the inlet valve and the outlet valve are preloaded so as to remain closed when a pressure difference between the pumping chamber and the inlet passage is lower than a first pressure threshold and when the pressure difference between the outlet passage and the pumping chamber is lower than a second pressure threshold which is higher than the first pressure threshold, respectively.

7. A micropump according to claim 1, comprising:

a first pumping membrane made of semiconductor material and delimiting the pumping chamber on a first side;

a first electrode structure, capacitively coupled to the first pumping membrane and configured to apply a first electrostatic force to the first pumping membrane in the presence of a first actuating voltage between the first electrode structure and the first pumping membrane; and a control unit, configured to apply the first actuating voltage in the form of a periodic wave at a controlled frequency.

8. A micropump according to claim 7, comprising a third recess, delimited on one side by the first pumping membrane and fluidly decoupled from the pumping chamber, the first electrode structure being arranged on a wall of the third recess opposite to the first pumping membrane and configured to retract the first pumping membrane within the third recess.

9. A micropump according to claim 7, wherein the first electrode structure comprises a plurality of first electrodes and the control unit is configured to apply a respective first actuating voltage to each first electrode.

10. A micropump according to claim 7, comprising:

a second pumping membrane made of semiconductor material and delimiting the pumping chamber on a second side opposite to the first side; and a second electrode structure, capacitively coupled to the second pumping membrane and configured to apply a second electrostatic force to the second pumping membrane in response to a second actuating voltage between the second electrode structure and the second pumping membrane;

the control unit being configured to supply the second actuating voltage in the form of a periodic wave with a controlled frequency equal to the frequency of the first actuating voltage.

11. A micropump according to claim 10, comprising a fourth recess, delimited on one side by the second pumping membrane and fluidly decoupled from the pumping chamber, the second electrode structure being arranged on a wall of the fourth recess opposite to the second pumping membrane and configured to retract the second pumping membrane within the fourth recess.

12. A micropump according to claim 10, wherein the second electrode structure comprises a plurality of second electrodes and the control unit is configured to apply a respective second actuating voltage to each second electrode.

13. A micropump according to claim 1, comprising an auxiliary electrode structure, arranged on a wall of the second recess opposite to the outlet shutter element, capacitively coupled to the outlet shutter element and configured to apply an auxiliary electrostatic force to the outlet shutter element in the presence of an auxiliary actuating voltage between the auxiliary electrode structure and the outlet shutter element.

* * * * *